United States Patent [19]

Lechtzin

[11] 4,343,684

[45] Aug. 10, 1982

[54] METHOD OF ELECTROFORMING AND PRODUCT

[76] Inventor: Stanley Lechtzin, 7705 Woodlawn Ave., Melrose Park, Pa. 19126

[21] Appl. No.: 218,275

[22] Filed: Dec. 19, 1980

[51] Int. Cl.[3] ..... C25D 1/20; C25D 3/62; C25D 5/50

[52] U.S. Cl. ..... 204/4; 204/8; 204/37 R; 204/43 G

[58] Field of Search ..... 204/8, 3, 4, 9, 37 R, 204/43 G

[56] References Cited

U.S. PATENT DOCUMENTS

| | | | |
|---|---|---|---|
| 2,719,821 | 10/1955 | Campana | 204/43 G |
| 3,749,650 | 7/1973 | Dettke | 204/43 G |
| 3,953,246 | 4/1976 | Wilson | 204/37 R |

FOREIGN PATENT DOCUMENTS

| | | | |
|---|---|---|---|
| 530472 | 12/1972 | Switzerland | 204/3 |
| 8905 | of 1841 | United Kingdom | 204/8 |
| 287641 | 3/1928 | United Kingdom | 204/37 R |

OTHER PUBLICATIONS

Plating, Mar. 1975.
Metal Finishing, Feb. 1956, pp. 52–56.
Zhurnal Prikladnoi Khimii,vol.50, No. 12, pp. 2698–2701, Dec. 1977.
Metal Techniques for Craftsmen by Oppi Untracht, Doubleday & Company, Inc., 1968, pp. 379–390.
Contemporary Jewelry by Philip Morton, Holt, Rinehart and Winston, Inc., 1970, pp. 166–169.
Contemporary Jewelry by Philip Morton, Holt, Rinehart and Winston, 1976, FIGS. 454–468.
Metal Finishing, Jan. 1979, vol. 77, No. 13, pp. 432–440.
Jewelers' Circular-Keystone, Nov. 1980, pp. 63–76, article entitled "Metalcrafting, Creating Tomorrow's Designs".

*Primary Examiner*—T. Tufariello
*Attorney, Agent, or Firm*—Weiser, Stapler & Spivak

[57] ABSTRACT

The method of achieving a karat gold electroform includes the steps of forming an easily workable, substrate to a desired configuration and then applying an electrically conductive surface treatment if necessary. The configured, treated substrate is electroplated in a metallic bath until a self-supporting metallic shell is formed over the substrate. In known manner, the substrate is removed. The metallic shell is cleaned and then placed in a karat gold electroforming bath wherein a gold piece is built to the desired final thickness and karat by controlling current density and the plating time. The karat gold electroformed piece can be stress relieved by annealing at elevated temperatures for suitable periods of time and is then immersed in an acid bath to remove the metallic shell from the piece interior, thereby producing a configured shell of karat gold.

11 Claims, No Drawings

METHOD OF ELECTROFORMING AND PRODUCT

BACKGROUND OF THE INVENTION

The present invention relates generally to the field of electroplating or electroforming, and more particularly, is directed to the electrodeposition of karat gold upon a disposable substrate.

The process of electroplating is well known and consists generally of passing a direct electrical current through a solution or bath between two electrically conducting materials or poles which are placed in the solution at the positive and negative terminals of the direct current circuit. Electroforming is an electroplating process which utilizes special plating baths and which has been employed by prior workers in the art to produce an exact metallic reproduction of a model or substrate by forming thereon a relatively thick deposit of metal from the bath. The substrate may or may not be removed as required by the final commercial product, such as a master record or an article of jewelry. Electroforming has been successfully utilized by prior workers in the art to form relatively large pieces of gold jewelry at greatly reduced prices, when considering the size of the piece and the cost of a comparatively sized solid gold object. By employing a disposable substrate as a model and then plating pure gold over the model, there was thereby formed a hollow, configured, gold product which required considerably less gold than would otherwise be required when fabricating the piece by utilizing conventional gold working techniques.

When employing a substrate or model of non-conductive material, such as wax or expanded polystyrene, the model surfaces first had to be rendered electroconductive before the surfaces could be electroformed. In order to accomplish this, prior workers in the art have usually selected a solution containing a conductive metal and they sprayed, dipped or painted it over those surfaces of the model selected for electroforming. In one known technique, a model was first placed in a copper depositing solution or bath by attaching the model to the cathode by a copper wire and then immersing it in the electroplating bath to produce the formation of a film of copper over the substrate of sufficient thickness to form a suitable, conductive base for deposit of a noble metal, for example metallic silver or metallic gold. After cleaning by rinsing, the copper coated mandrel or substrate was placed in a silver or gold plating bath until the desired final thickness of silver or pure gold was formed in the exact configuration of the model. After electroforming the desired thickness of metallic silver or gold, the piece was then removed from the bath and the substrate material was then removed by employing suitable, known methods.

In order to produce gold electroforms, the prior workers in the art have usually employed a hot gold cyanide bath or electrolyte comprising a solution of gold, potassium or sodium cyanide, and dipotassium or disodium phosphate. The bath preferably was heated to 160°–180° F., and a current density between 1 to 5 amperes per square foot was employed. When thick gold deposits were desired, a greater percentage of gold in the bath was employed since this permits higher current densities and higher cathode efficiencies. It was found that higher temperatures and increased bath agitation could be employed to favor higher plating speeds.

The prior art electroforming techniques and procedures have generally proved acceptable to produce fine gold-veneered and silver jewelry and other commercial articles of precisely controlled configuration. When using the prior art gold electroforming techniques, the deposited gold was substantially twenty-four karat gold, a desirable product that could be mechanically formed or otherwise treated, such as by gold soldering. However, the final product was expensive and because of its purity, was quite soft.

In the past such techniques were generally successful and any gold products resulting from the known processes were considered to be uniquely formed, light of weight and of great merit. However, due to the ever increasing cost of gold, the need remains to develop a process that is capable of producing gold articles of acceptable size and quality, but which require even smaller quantities of pure gold. The existing procedures have never successfully been adapted to produce an acceptable karat gold electroform and all previous attempts resulted in gold deposits that failed either due to brittleness and/or through failure to build up the required thickness of deposit. Research has disclosed that there are no existing processes presently available for creating commercially acceptable, relatively thick, karat gold electroforms. The term "thick" karat gold electroform as utilized herein, is defined to mean a thickness of approximately 0.007 inches (0.013 cm.) or greater.

SUMMARY OF THE INVENTION

The present invention relates generally to the field of electroforming, and more particularly, is directed to a novel process for electroforming highly stylized or intricately configured objects in alloy or karat gold.

In an effort to find a workable karat gold electroforming process, initial tests were conducted by employing a known acid gold electrolyte comprising gold, copper, cadmium and arsenic and alternately, a known alkaline cyanide electrolyte containing gold, copper and cadmium. The gold content and the other bath constituents were varied in each instance in a series of tests to determine whether increased gold deposition rates could be achieved. The tests proved that the modification of known bath formulations produced little or no beneficial results. Initial tests conducted with a wax matrix made electrically conductive by a coating of a silver bearing shellac or lacquer under varying plating conditions in both baths yielded highly stressed deposits that failed due to cracking when they reached approximately 0.003 inches. It was found that the alkaline cyanide bath, when used at elevated temperatures, resulted in slightly less stressed deposits.

The initial research developed that it was desirable to utilize wax as the matrix material due to its characteristics of being easily formed to the desired configuration by employing well known techniques and being readily meltable at temperatures below the boiling temperature of water. Accordingly, wax possesses the distinct material advantage of being easily removable from an electroform by immersing a matrix and its electroformed deposit in boiling water. However, numerous other matrix materials could similarly be employed in the process and still fall within the spirit and intent of this invention. Additionally, it will be appreciated that other gold electrolytes that are capable of producing gold alloy deposits which are smooth and uniform can be adapted for use in the process.

Early tests utilizing a wax matrix and increasing bath temperatures to allow increased plating current in the known manner with faster gold deposition rates continually resulted in deposit failure due to wax expansion. It was then attempted to maintain the bath temperature constant and gradually increase the plating current. A self-supporting deposit was thereby achieved and the wax substrate was boiled out. However, the resulting electroform proved to be very brittle and entirely unusable for the intended purpose. Additional tests at constant bath temperature but with periodic current reversal and cathode agitation were performed, but in each instance, the resulting electroform was highly stressed and brittle.

It was then determined to first plate the mandril in copper to create a strong metallic shell to withstand the stresses due to wax expansion. The copper plated mandril was electroformed in the gold electrolyte, the wax substrate was then boiled out and the copper shell was etched away, leaving a karat gold shell. Failure due to cracking occurred soon after the copper was removed. Subsequent tests proved that the karat of the gold deposits could be controlled by varying current density, but the problem of brittleness due to stresses remained.

Continued experimentation developed the technique of stress releaving the gold electroform in an annealing oven while the copper supporting shell was still intact. After the electroform was fully stress relieved, the copper shell could then be etched away, thereby resulting in a completely self-supporting, stress relieved, ductile, electroform in karat gold suitable for further treatment in known manner, such as soldering or other mechanical procedures.

It is therefore an object of the present invention to provide an improved method of electroforming and product resulting therefrom.

It is another object of the present invention to provide a novel method of electroforming karat gold.

It is another object of the present invention to provide a novel method of electroforming including the steps of electroforming a self-supporting metallic shell over a removable matrix, removing the matrix, depositing a karat gold electroform over the metallic shell, stress releaving the gold electroform and then etching away the inner metallic shell.

It is another object of the present invention to provide a novel method of electroforming karat gold comprising the steps of forming a mandril to a desired configuration, plating a metallic shell over the mandril, producing a karat gold electroform over the metallic shell and creating the desired gold content in the electroform by varying the current density.

It is another object of the present invention to provide a novel method of electroforming karat gold and product resulting therefrom that employs readily available equipment, that is capable of precise control and that is trouble free when in use.

Other objects and a fuller understanding of the invention will be had by referring to the following description and claims of a preferred embodiment of the invention. Although specific terms are used in the following description for the sake of clarity, these terms are intended to refer only to the particular method of the invention selected for illustration, and are not intended to define or limit the scope of the invention.

DESCRIPTION OF THE PREFERRED EMBODIMENT OF THE INVENTION

In order to develop a practical method of producing a karat gold electroform, an alkaline gold electrolyte of known composition containing gold, copper, cadmium and cyanide in a water solution was chosen. It will be appreciated however that any gold electrolyte that is capable of producing gold alloy deposits which are smooth and uniform can be adapted for use in the process. A non-conductive matrix, preferably of wax, was chosen as a substrate for the electroform for use in all tests leading to the development of the process forming the subject matter of the present invention.

TEST 1

Using an alkaline gold electrolyte, a wax substrate was plated at 0.10 amps. for 0.15 amphere hours starting with a bath temperature of 110° F. The temperature was chosen so as not to soften or appreciably expand the wax. The bath temperature was then raised to 125° F. and it was hoped that the deposit could withstand the additional stresses caused by the expansion of the wax. The attempt was made to gradually raise the temperature of the bath as the deposit thickness was increased as it was anticipated that the increasing pressures of the expanding wax matrix could then be tolerated.

Plating current was raised to 0.5 amps. for an additional 0.15 amp. hours in an effort to establish a usable thickness of deposit in as short a period as possible. The bath temperature was raised to 140° F., but before plating could resume, the deposit failed.

TEST 2

Using the test set up of Test 1, plating was started at 110° F. at 0.1 amps for 0.1 amp. hr. The temperature was raised to 115° F. at 0.1 amps. for an additional 0.15 amp. hrs. The bath temperature was increased to 140° F., plating at 0.1 amps. for 0.2 amp. hrs.

The deposit then failed, although this procedure resulted in a somewhat thicker deposit.

TEST 3

Using the test set up of Test 1, plating was started at 110° F. at 0.2 amps. for 0.1 amp. hrs. The bath temperature was raised to 115° F. at 0.2 amps. for 0.18 amp. hrs. The bath temperature was then raised to 120° F. at 0.25 amps. for 0.2 amp. hrs. The bath temperature was then raised to 125° F. at 0.25 amps. for 0.25 amp. hrs., at which time the deposit failed. The result was a somewhat thicker deposit, but still not a usable product.

TEST 4

Using the test set up of Test 1, plating was started at 100° F. in an effort to keep wax expansion to a minimum at 0.05 amps. and then raising gradually to 0.15 amps for 0.25 amp hrs. A deposit was achieved which was self-supporting and the wax matrix was then removed by inserting the electroform together with the wax matrix in boiling water. The electroform appeared sound but examination proved it to be very brittle, whereby it cracked during the final cleaning process. It is noteworthy that this is the first self-supporting gold electroform produced to date.

TEST 5

The procedures of Test 4 were repeated but care was taken not to damage the electroform after removal from the wax boil out solution. The self-supporting electroform was then additionally plated at 100° F. at 0.5 amps. for an additional 0.4 amp hrs. Periodic current reverse was introduced in a cycle of 15 seconds forward and 1 second reverse in an effort to create a smoother, less stressed deposit. This deposit ultimately cracked after 0.165 amp hrs.

TEST 6

Using the test set up of Text 1, plating was started at 100° F. at 0.5 amps. for 0.25 amp hrs. and then the wax was boiled out. After removal from the wax boil out solution, electroform was additionally plated at 0.25 amps. for 0.75 amp hrs. at 100° F. This resulted in a good electroform, but the product was still quite brittle.

TEST 7

Using the test set up of Test 1, plating was started at 100° F. at 0.15 amps for 0.25 amp hrs. Periodic current reverse of 60 seconds forward and 1 second reverse was introduced and then the wax was boiled out. The electroform was additionally plated at 0.25 amps. for 0.75 amp. hrs. at 150° F. using 60 seconds forward and 10 seconds periodic current reverse. The result was a self-supporting electroform but the product was still highly stressed.

TEST 8

Test 7 was repeated but using a bath scaled up to 4 liters in an effort to reduce particulate matter building up during the plating process. Continuous filtration was also employed which resulted in an electroform of the same properties, but with a smoother surface.

TEST 9

Using the test set up of Test 1, plating was started at 100.4° F. for 0.15 amps. for 0.38 amp. hrs. using a periodic current reverse of 60 seconds forward and 1 second reverse. Rapid cathode agitation was introduced but the deposit cracked at 0.35 amp hrs. due to high current.

TEST 10

Using the test set up of Test 1, plating was started at 100.4° F. at 0.1 amps. for 0.107 amp. hrs. and thickness of deposit of 0.003 inches was achieved. Periodic current reverse of 60 seconds forward and 2 seconds reverse with slow cathode rotation was introduced. Wax was boiled out and the electroform remained in the boiled out solution for 15 minutes in an effort to relieve stresses. Plating then continued at 150.8° F. at 0.25 amps. for 0.1 amp. hrs. using periodic current reverse of 60 seconds forward and 4 seconds reverse with slow cathode rotation. Another attempt was made to stress relieve the object by immersing it in boiling water. Plating continued again at 150.8° F. at 0.25 amps. for 0.1 amp. hrs. using periodic reverse of 60 seconds forward and 4 seconds reverse. The object was again immersed in boiling water and it was noted that a total thickness of 0.007 inches was achieved at a total plating time of 0.321 amp. hrs. Stress was not relieved by the boiling water and it was found that the removing and replacing of the object in the bath on several occasions created a series of non-adherent layers rather than a homogeneous deposit. Accordingly, attempts to stress relieve by periodic boiling were abandoned.

TEST 11

Prior to gold electroforming, the matrix was first plated at 0.18 amps. in a copper solution for ½ an hour in an effort to create a strong metallic shell to address the problem of stresses caused by wax expansion. The piece was then rinsed and moved into the gold electroforming bath of Test 1. Plating was started at 104° F. at 0.4 amps. for 2 hours using periodic current reverse of 60 seconds forward and 4 seconds reverse. The wax mattrix was then boiled out and the copper undercoat was etched out in a concentrated nitric acid solution. This left a karat cold shell which was highly brittle and stressed. The sample cracked soon after the copper was etched away. In view of the results, it was decided to next plate for a longer period of time to create a thicker deposit in an effort to prevent cracking.

TEST 12

A primary copper shell was formed over the matrix as in Test 11 and then plating was started at 150.8° F. at 1 amp. for 7½ hours using periodic current reverse of 60 seconds forward and 4 seconds reverse with slow cathode rotation. This resulted in a deposit of 0.013 inches thickness. The electroform was assayed at 17.5 karats.

TEST 13

A wax mattrix was plated at 1 amp. in a copper bearing solution for ½ hr. to obtain a usable copper electroform. The wax was then boiled out and the piece was electrocleaned and placed in the gold bath. Plating was started at 104° F. at 0.2 amps. for 2 hrs. using periodic current reverse of 60 seconds forward and 4 seconds reverse. It was determined that the periodic current reverse was not improving the deposit in any significant way and accordingly, it was determined to discontinue this practice. Plating was continued at 150.8° F. at 0.175 amps. for 6 hrs. for a final deposit thickness of 0.010 inches. This test deposit assayed to 20.5 karat.

TEST 14

A wax matrix was formed measuring exactly 2.5 square inches and was creased in its center to form a 90° angle. The test matrix was plated in copper to form a self-supporting copper electroform and the wax was then removed by boiling. Plating was started at 150.8° F. at 0.2 amps. for 0.5 amp. hrs. for 3 hrs. The current density was 11.5 amps. per square ft. and the test deposit assayed to 21.25 karat.

TEST 15

Using an identical wax matrix and copper coating as in Test 14, plating was started at 150.8° F. at 0.26 amps. for 0.527 amp. hrs. for 3 hrs. This was a current density of 15 amps. per square ft. This test assayed to 20.25 karat.

TEST 16

Using an identical wax matrix and copper electroform as in Test 14, the sample was plated at 150.8° F. at 0.35 amps. for 0.5 amp. hrs. for 2½ hrs. The current density was 20 amps. per square ft. and the test piece assayed to 17.8 karat.

TEST 17

A wax matrix was copper electroformed as in Test 7 and plating was started at 150.8° F. at 0.43 amps. for 0.6 amp hrs. for 2 hrs. The current density was 25 amps. per square ft. and the test piece assayed to 15.6 karat.

As can be seen from the foregoing, Tests 14–17 prove that the karat of the deposit is directly related to the current density. As the current density increased from 11.5 amps. per square ft. to 25 amps. per square ft., the karat of the deposit decreased. There is an inverse ratio between current density and karat. The faster one plates, the lower the karat and vice versa. In view of the test results of Tests 14–17, a graph could be plotted from which an accurate prediction of the karat of a deposit can be calculated by accurately controlling the current density.

After completing the electroforming procedure to obtain a karat gold electroform of the desired karat, the finished electroform should be thoroughly rinsed in water and then heat treated to relieve stresses. The cleaned electroform can be placed in an annealing oven of conventional design and then heated from room temperature to 650° F. gradually over a period of 4 hours. This allows the stresses inherent in the electroform to be gradually relieved without any radical distortion of the electroform. It has been noted that the electroforms do not undergo any significant change during this period of time other than to become darkened due to oxidation.

At the end of the initial 4 hour annealing period, the oven temperature was raised to 900° F. for 1 hour and then raised to 1100° F., a procedure which resulted in a fully annealed electroform that was completely stress relieved. The annealed karat gold electroform was quite ductile to which additional elements could be gold soldered or upon which the usual mechanical work could be performed. The supporting copper shell could then be removed.

In producing a finished karat gold electroform, the test results show the desirability of performing the following steps:

1. Form a wax or other material model to the appropriate configuration and then treat as necessary to make surface areas electrically conductive.

2. Attach a suitable copper wire and plate the model in copper until a self-supporting copper shell is achieved.

3. If wax is used as the mandrel, remove the wax by boiling.

4. Thoroughly clean the object and prepare as necessary for subsequent plating in a karat gold electroforming bath.

5. Calculate and regulate the current density to achieve the desired karat gold electroform and then build up the object in the karat gold electroforming bath to the desired final thickness.

6. When the final thickness has been achieved, thoroughly rinse the object and then stress relieve in an annealing oven over a period of at least four hours by gradually raising the temperature to a maximum of 1100° F.

7. After annealing, allow the electroform to cool to room temperature and then drill as necessary to provide drainage holes through the interior of the piece.

8. Immerse the electroform piece in concentrated nitric acid to dissolve the copper shell from the interior, thereby leaving a karat gold electroform which can be used in any manner desired.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

I claim:

1. The method of gold electroforming utilizing an acid electrolyte containing gold or an alkaline electrolyte containing gold at a temperature above 100 degrees F. comprising the steps of forming a non-metallic substrate to a desired configuration;

applying a metallic shell over at least portions of the substrate;

placing the substrate with shell into the electrolyte;

electroforming at a current density of between approximately eleven amperes per square foot and approximately twenty-five amperes per square foot a self-supporting gold deposit of a first karat over the metallic shell; and annealing the gold deposit at a temperature in excess of room temperature for a period of at least four hours to remove stresses and brittleness.

2. The method of claim 1 and the further step of removing the non-metallic substrate from the metallic shell prior to annealing.

3. The method of claim 1 wherein the step of applying comprises placing the substrate in a copper containing bath and electroplating a copper metallic shell over the portions of the substrate.

4. The method of claim 1 and removing the metallic shell from the gold deposit after annealing, the removing comprising placing the metallic shell and the annealed gold deposit in an acid solution.

5. The method of claim 1 wherein the electroforming is continued for a sufficient period of time until the thickness of the gold deposit is at least about 0.007 inches.

6. The method of claim 1 wherein the step of annealing comprises placing the combined metallic shell and karat gold deposit in an annealing oven and maintaining the combined metals at the elevated temperatures for the period of time.

7. The method of claim 1 and the further step of varying the current density employed in electroforming to produce a gold deposit of a second karat.

8. A gold product made in accordance with claim 1 in which the gold deposit is karat gold between about fifteen karat and about twenty-one karat.

9. The gold product of claim 8 in which the deposit is at least about 0.007 inches in thickness.

10. The gold product of claim 8 in which the non-metallic substrate is removed from the metallic shell.

11. The gold product of claim 8 or 10 in which the metallic shell is removed from the gold deposit.

* * * * *